US010343248B2

(12) United States Patent
Miyamoto

(10) Patent No.: US 10,343,248 B2
(45) Date of Patent: Jul. 9, 2019

(54) GRINDING APPARATUS

(71) Applicant: DISCO CORPORATION, Tokyo (JP)

(72) Inventor: Hiroki Miyamoto, Tokyo (JP)

(73) Assignee: Disco Corporation, Tokyo (JP)

( * ) Notice: Subject to any disclaimer, the term of this patent is extended or adjusted under 35 U.S.C. 154(b) by 41 days.

(21) Appl. No.: 15/655,964

(22) Filed: Jul. 21, 2017

(65) Prior Publication Data

US 2018/0021911 A1 Jan. 25, 2018

(30) Foreign Application Priority Data

Jul. 22, 2016 (JP) ..... 2016-144144

(51) Int. Cl.

| | |
|---|---|
| ***B24B 57/00*** | (2006.01) |
| ***B24B 55/12*** | (2006.01) |
| ***B24B 37/30*** | (2012.01) |
| ***B24B 7/22*** | (2006.01) |
| ***B24B 41/06*** | (2012.01) |
| ***B24B 47/06*** | (2006.01) |
| ***B24B 47/08*** | (2006.01) |
| *B24B 49/10* | (2006.01) |
| *B24B 55/02* | (2006.01) |

(52) U.S. Cl.

CPC ..... *B24B 7/228* (2013.01); *B24B 37/30* (2013.01); *B24B 41/06* (2013.01); *B24B 47/06* (2013.01); *B24B 47/08* (2013.01); *B24B 55/12* (2013.01); *B24B 57/00* (2013.01); *B24B 49/10* (2013.01); *B24B 55/02* (2013.01)

(58) Field of Classification Search

CPC ..... B24B 7/228; B24B 13/005; B24B 37/04; B24B 37/30; B24B 55/12; B24B 57/00; B24B 55/02; H01L 21/6838

USPC ..... 451/36, 41, 285, 289, 388

See application file for complete search history.

(56) References Cited

U.S. PATENT DOCUMENTS

| | | | | |
|---|---|---|---|---|
| 4,597,228 A * | 7/1986 | Koyama | ..... | B24B 7/228 451/289 |
| 5,658,185 A * | 8/1997 | Morgan, III | ..... | B24B 37/16 438/693 |
| 5,665,249 A * | 9/1997 | Burke | ..... | B24B 37/04 216/2 |

(Continued)

FOREIGN PATENT DOCUMENTS

| | | | | |
|---|---|---|---|---|
| JP | 11235663 A * | 8/1999 | ..... | B24B 7/228 |
| JP | 2001-287141 | 10/2001 | | |
| JP | 2004-019912 | 1/2004 | | |

*Primary Examiner* — Eileen P Morgan

(74) *Attorney, Agent, or Firm* — Greer Burns & Crain, Ltd.

(57) ABSTRACT

A grinding apparatus includes a holding unit including a holding table having a holder for holding a workpiece and a grinding water suction part for drawing in grinding water outside of the holder, a rotational shaft having an end fixed centrally to a bottom surface of the holding table, a tubular rotary joint surrounding the rotational shaft, and a motor rotating the rotational shaft about its own axis. The rotational shaft has a first suction channel held in fluid communication with the holder of the holding table and a second suction channel held in fluid communication with the grinding water suction part. The rotary joint has a communication channel by which the first suction channel and the second suction channel are held in fluid communication with at least a suction source.

7 Claims, 3 Drawing Sheets

(56) References Cited

U.S. PATENT DOCUMENTS

| | | | | | |
|---|---|---|---|---|---|
| 5,735,731 | A * | 4/1998 | Lee | B24B 37/22 | 451/143 |
| 5,809,987 | A * | 9/1998 | Wark | B28D 5/0094 | 125/12 |
| 6,050,880 | A * | 4/2000 | Kato | B24B 7/228 | 451/287 |
| 6,080,046 | A * | 6/2000 | Shendon | B08B 1/007 | 257/E21.23 |
| 6,159,082 | A * | 12/2000 | Sugiyama | B24B 37/04 | 451/285 |
| 6,190,236 | B1 * | 2/2001 | Drill | B24B 37/26 | 451/285 |
| 6,193,586 | B1 * | 2/2001 | Park | B24B 7/228 | 451/388 |
| 6,227,950 | B1 * | 5/2001 | Hempel | B24B 37/20 | 451/288 |
| 6,379,230 | B1 * | 4/2002 | Hayashi | B24B 27/0023 | 451/287 |
| 6,530,397 | B2 * | 3/2003 | Suzuki | F16L 39/04 | 137/580 |
| 2007/0063453 | A1 * | 3/2007 | Ishikawa | B24B 37/30 | 279/3 |
| 2010/0267317 | A1 * | 10/2010 | Takahashi | B24B 37/30 | 451/388 |
| 2016/0346902 | A1 * | 12/2016 | Toyomura | B24B 57/02 | |

* cited by examiner

GRINDING APPARATUS

BACKGROUND OF THE INVENTION

Field of the Invention

The present invention relates to a grinding apparatus for grinding a workpiece held on a holding table while supplying grinding water to the workpiece.

Description of the Related Art

Plate-like workpieces such as semiconductor wafers or the like are ground to a predetermined thickness by a grinding apparatus (see, for example, Japanese Patent Laid-Open No. 2001-287141) and then divided by a cutting apparatus or the like into individual device chips, which will be used in various types of electronic devices or the like. The grinding apparatus has a holding table for holding a workpiece on its upper holding surface under suction, with a rotational shaft having an upper end coupled to the lower surface of the holding table.

The holding surface of the holding table is held in fluid communication with a suction source such as a vacuum generator or the like through a suction channel defined in the rotational shaft, for example. A suction force that is generated by the suction source is transmitted via the suction channel to the holding surface of the holding table, which holds the workpiece under the suction force on the holding surface. Between the holding table and the suction source, there is disposed a rotary joint (see, for example, Japanese Patent Laid-Open No. 2004-019912) for transmitting the suction force that generated by the suction source to the suction channel defined in the rotational shaft without leakage.

SUMMARY OF THE INVENTION

The rotary joint as disclosed in Japanese Patent Laid-Open No. 2004-019912 has a housing that surrounds the rotational shaft fixed to the holding table. The rotary joint keeps a channel defined in the housing in fluid communication with the suction channel in the rotational shaft, making it possible to keep the holding surface of the holding table and the suction source in fluid communication with each other even while the rotational shaft is rotating.

The rotary joint must not impede rotary motion of the rotational shaft while at the same time preventing the fluid from leaking out of the channel. If the inner circumferential surface of the housing of the rotary joint and the outer circumferential surface of the rotational shaft are held in completely intimate contact with each other, then the rotary joint can fully prevent the fluid from leaking out although rotation of the rotational shaft is hampered by the intimately contacting surfaces. To alleviate this difficulty, a mechanical seal for preventing the fluid from leaking is disposed in the rotary joint. The mechanical seal includes a rotary sealing ring that is axially movable along the rotational shaft by a spring or the like and rotatable in unison with the rotational shaft and a fixed sealing ring that is axially immovable and nonrotatable. The rotary sealing ring is pressed against the fixed sealing ring by the force of the spring. The rotary sealing ring has a sliding surface lying perpendicularly to the rotational shaft and the fixed sealing ring also has a sliding surface lying perpendicularly to the rotational shaft. In operation, the sliding surfaces of the rotary and fixed sealing rings are held in contact with each other, and the rotary sealing ring and the fixed sealing ring rotate relatively to each other, minimizing any fluid leakage from the channel while leaving a micron-size clearance between the housing and the rotational shaft to allow the rotational shaft to rotate without being disturbed by the housing. The micron-size clearance, i.e., a so-called sealing space, between the housing and the rotational shaft is supplied with water, which fills the sealing space to provide an enhanced sealing capability for the fluid, e.g., air, flowing through the rotary joint and to make it possible to cool the sealing surfaces of the mechanical seal.

While the grinding apparatus is grinding the workpiece, the workpiece is held under suction on the holding table. At this time, grinding water is drawn in from a small gap between the holding surface of the holding table and the surface of the workpiece that is held thereon or a gap between the outer peripheral edge of the workpiece and the holding surface of the holding table. More specifically, grinding water supplied through grinding means or the like to the workpiece held on the holding table is drawn in from the holding surface of the holding table, and then led into the rotary joint. The grinding water guided into the rotary joint is effective to prevent the rotary joint from malfunctioning on account of the frictional heat generated by the mechanical seal upon rotation of the rotational shaft and also to fill the sealing space in the rotary joint with water for an increased sealing capability.

In some grinding modes, however, the grinding water cannot be led into the rotary joint while the workpiece is being ground. For example, if a protective tape is applied to a surface of the workpiece opposite the surface thereof that is to be grounded, the protective tape has an outer circumferential portion applied to an annular frame, so that the workpiece is supported on the annular frame. In this case, since the entire holding surface of the holding table is covered with the protective tape, the grinding water cannot be drawn in from the holding surface and hence cannot be guided into the rotary joint. Furthermore, if the suction force generated by the suction source is intensified to hold the workpiece more strongly on the holding surface of the holding table, the grinding water cannot be drawn in from the holding surface and hence cannot be led into the rotary joint. In the absence of grinding water running through the rotary joint, the water in the sealing space in the rotary joint tends to vaporize with the frictional heat generated by the mechanical seal upon rotation of the rotational shaft, making the rotary joint dry inside. As a result, the frictional heat further increases, possibly causing damage to the rotary joint.

The grinding water may be led into the rotary joint when the ground workpiece is unloaded from the holding table. Specifically, for unloading the ground workpiece from the holding table, an air supply source supplies air to the holding surface of the holding table, lifting the workpiece off the holding surface under the pressure of air ejected from the holding surface, so that the workpiece is released from the holding table against the suction force. After the workpiece has been released from the holding table, the grinding water can be led into the rotary joint. When a harder workpiece such as a sapphire substrate or an SiC substrate is ground by the grinding apparatus, the workpiece is held under suction on the holding table for longer than usual because more time is required to grind the workpiece. Consequently, the grinding water that is led into the rotary joint when the ground workpiece is released from the holding table may have vaporized approximately by the time one workpiece finishes being ground. As a result, the rotary joint may be damaged by the frictional heat generated by the mechanical seal upon rotation of the rotational shaft.

Therefore, one task that the grinding apparatus needs to achieve is that even if it is difficult to guide grinding water into the rotary joint from the holding surface of the holding table, the grinding water should efficiently be led into the rotary joint to prevent the rotary joint from being damaged by frictional heat.

It is therefore an object of the present invention to provide a grinding apparatus in which grinding water is efficiently introduced into a rotary joint to prevent the rotary joint from being damaged by frictional heat.

In accordance with an aspect of the present invention, there is provided a grinding apparatus including holding means for holding a workpiece, and grinding means for grinding the workpiece held by the holding means with a grinding stone while supplying grinding water to the workpiece, wherein the holding means includes a holding table having a holder for holding the workpiece under suction and a grinding water suction part for drawing in grinding water outside of the holder, a rotational shaft having an end fixed centrally to a bottom surface of the holding table, a tubular rotary joint surrounding the rotational shaft, and rotating means for rotating the rotational shaft about its own axis, the rotational shaft has a first suction channel held in fluid communication with the holder of the holding table and a second suction channel held in fluid communication with the grinding water suction part, the tubular rotary joint has a communication channel by which the first suction channel and the second suction channel are held in fluid communication with at least a suction source, and grinding water flowing into the second suction channel is present between the rotational shaft and the rotary joint.

Even though the holding surface of the holding table covered with a protective tape or the like, making it difficult to lead grinding water from the holding surface to the rotary joint, the grinding apparatus according to the present invention allows grinding water to flow into the second suction channel, from which the grinding water is introduced and present between the rotational shaft and the rotary joint. The grinding water thus introduced and present between the rotational shaft and the rotary joint is effective to lower the frictional heat generated by the rotational shaft and the rotary joint during a grinding process. Since the water that is led into the rotary joint is grinding water, the grinding apparatus is not required to have a separate water source for supplying water dedicated to prevent the rotary joint from being damaged. Therefore, the grinding apparatus is economical.

The above and other objects, features and advantages of the present invention and the manner of realizing them will become more apparent, and the invention itself will best be understood from a study of the following description and appended claim with reference to the attached drawings showing a preferred embodiment of the invention.

DETAILED DESCRIPTION OF THE PREFERRED EMBODIMENT

Figure 1:
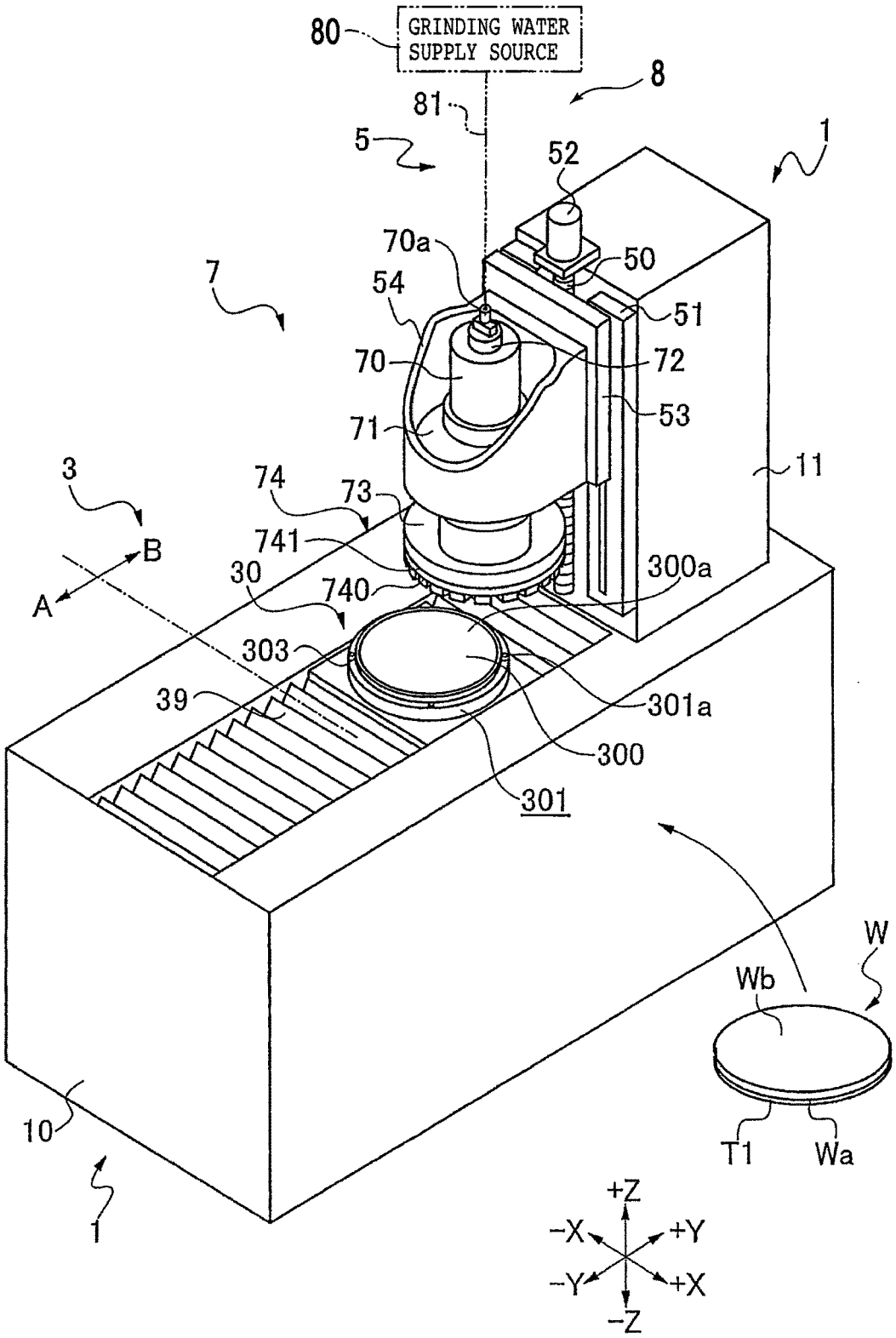
FIG. 1 is a perspective view of a grinding apparatus according to a preferred embodiment of the present invention.

FIG. 1 illustrates in perspective a grinding apparatus 1 according to a preferred embodiment of the present invention. The grinding apparatus 1 includes holding means 3 for holding a workpiece W on a holding table 30 thereof and grinding means 7 for grinding the workpiece W held on the holding table 30. The grinding apparatus 1 has a base 10 divided into a front section (extending in a −Y direction) serving as a loading/unloading region A where the workpiece W can be loaded on and unloaded from the holding means 3 and a rear section (extending in a +Y direction) serving as a grinding region B where the workpiece W held on the holding means 3 is ground by the grinding means 7.

The grinding apparatus 1 includes a column 11 vertically mounted in the grinding region B of the base 10 and grinding feed means 5 mounted on a side surface of the column 11 which faces in the −Y direction, for grinding-feeding the grinding means 7 vertically toward and away from the holding means 3. The grinding feed means 5 includes a ball screw 50 having a vertical central axis extending along Z-axis directions, a pair of guide rails 51 disposed one on each side of and extending parallel to the ball screw 50, a motor 52 coupled to the upper end of the ball screw 50, for rotating the ball screw 50 about its own central axis, a vertically movable plate 53 having an internal nut threaded through the ball screw 50 and a pair of sides held in sliding contact with the guide rails 51, and a holder 54 mounted on the vertically movable plate 53 and supporting the grinding means 7 thereon. When the motor 52 is energized to rotate the ball screw 50 about its own axis, the vertically movable plate 53 is vertically moved along the Z-axis directions while being guided by the guide rails 51, causing the grinding means 7 supported by the holder 54 to grinding-fed in the Z-axis directions.

The grinding means 7 for grinding the workpiece W held on the holding table 30 includes a rotational shaft 70 having a vertical central axis extending along Z-axis directions, a housing 71 by which the rotational shaft 70 is rotatably supported, a motor 72 coupled to the upper end of the rotational shaft 70, for rotating the rotational shaft 70 about its own central axis, an annular mount 73 connected to the lower end of the rotational shaft 70, and a grinding wheel 74 removably connected to the lower surface of the mount 73.

The grinding wheel 74 includes a wheel base 741 and a plurality of grinding stones 740, each shaped substantially as a rectangular parallelepiped, arranged in an annular pattern and mounted on the lower surface of the wheel base 741. Each of the grinding stones 740 is made of abrasive grains of diamond that are bonded together by a resin bond, a metal bond, or the like, for example. The grinding stones 740 may be replaced with an integral annular grinding stone.

Figure 2:
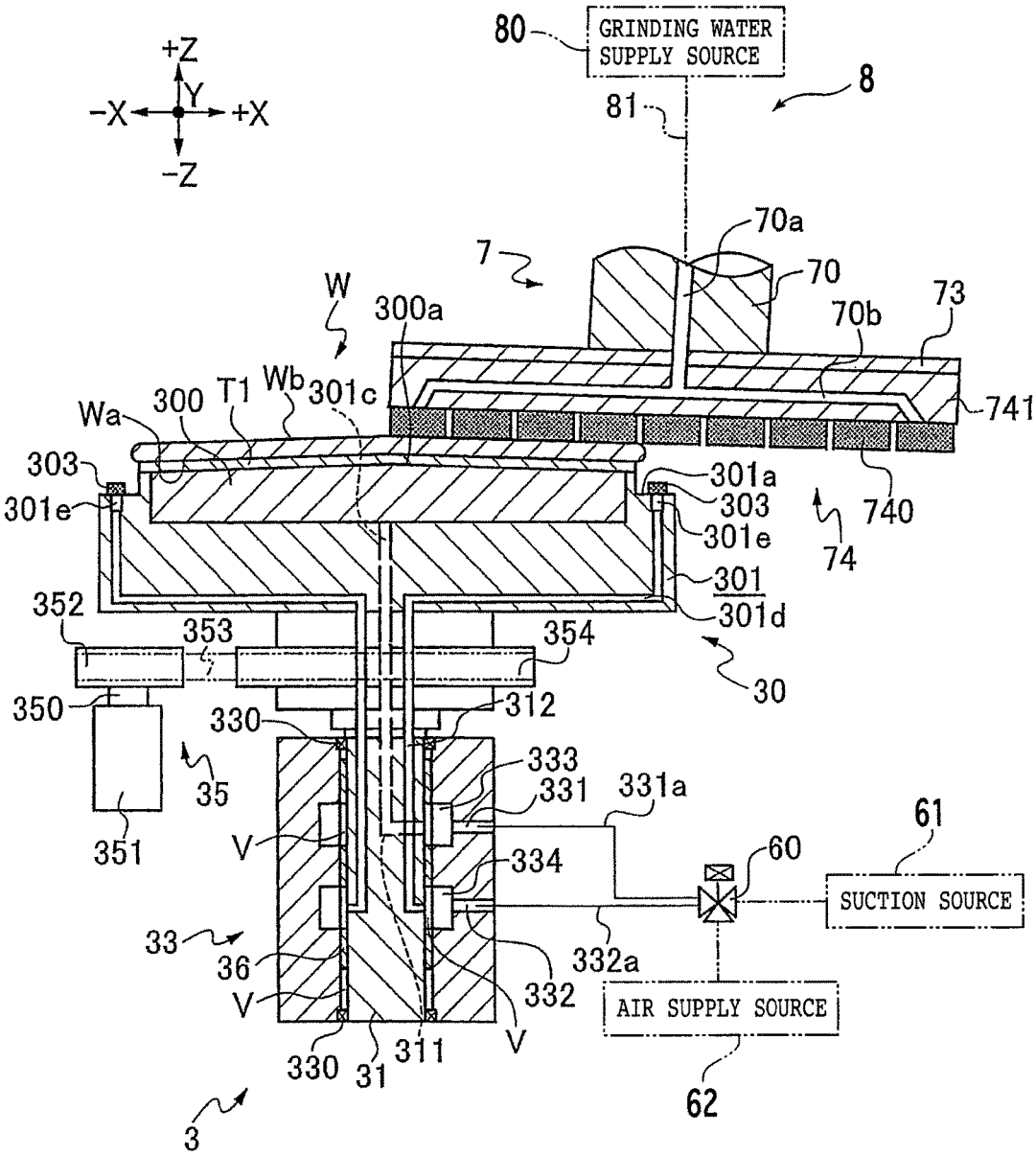
FIG. 2 is a vertical cross-sectional view of structural details of grinding means and holding means of the grinding apparatus illustrated in FIG. 1.

As illustrated in FIG. 2, the rotational shaft 70 has a channel **70*a* defined therein as a grinding water passageway and extending along the axial directions (Z-axis directions) of the rotational shaft 70. The channel 70*a* extends through the mount 73 and is held in fluid communication with a plurality of channels 70*b* defined in the wheel base 741. The channels 70*b* extend in the wheel base 741 perpendicularly to the central axis of the rotational shaft 70 and are angularly spaced at regular intervals in circumferential directions of the wheel base 741. The channels 70*b* have respective ends open at the lower surface of the wheel base 741 for ejecting grinding water toward the grinding stones 740**.

The grinding means 7 is connected to grinding water supply means 8 that supplies grinding water to the grinding means 7. The grinding water supply means 8 includes a grinding water supply source 80 such as a pump or the like as a water source and a pipe 81 connected to the grinding water supply source 80 and held in fluid communication with the channel 70*a* in the rotational shaft 70. The grinding water supply means 8 may alternatively include external nozzles for ejecting grinding water toward an area where the grinding stones 740 and the workpiece W are held in contact with each other.

As illustrated in FIG. 2, the holding means 3 that is disposed on the base 10 of the grinding apparatus 1 for holding the workpiece W under suction thereon includes a holding table 30 for holding the workpiece W under suction thereon, a rotational shaft 31 having an upper end fixed centrally to the bottom or lower surface of the holding table 30, a tubular rotary joint 33 surrounding the rotational shaft 31, and rotating means 35 for rotating the rotational shaft 31 about its own axis. The holding table 30 includes a holder 300 having a circular outer profile and made of a porous member or the like, for holding the workpiece W under suction thereon, and a frame 301 supporting the holder 300 thereon. The holder 300 has an upper exposed holding surface 300*a* formed as a conical surface, for example, whose vertex is aligned with the center of the holding table 30. The holder 300 is held in fluid communication with a suction source 61 illustrated in FIG. 2. When a suction force generated by the suction source 61 as it draws in air is transmitted to the holding surface 300*a*, the holding table 30 holds the workpiece W under suction on the holding surface 300*a* with the suction force. The holding table 30, which is rotatable by the rotating means 35, is horizontally surrounded by a bellows-shaped cover 39 illustrated in FIG. 1, and is reciprocally movable in Y-axis directions by Y-axis feeding means, not illustrated, disposed beneath the cover 39.

The frame 301 of the holding table 30 has a suction channel 301*c*, indicated by the broken lines, defined centrally therein and extending thicknesswise in the Z-axis directions. The suction channel 301*c* has an upper end held in fluid communication with the holder 300. The frame 301 also has a plurality of water guide channels 301*d* defined therein at regular angular intervals in the circumferential directions of the holding table 30. The frame 301 has an annular step, for example, formed on an upper surface thereof at an outer circumferential portion of the holding table 30. The water guide channels 301*d* have upper ends held in fluid communication with suction ports 301*e* that are defined in the frame 301 and open at an upper surface 301*a* of the annular step which is lower than the upper holding surface 300*a* of the holder 300. The suction ports 301*e* are positioned at circumferentially spaced regular intervals on the upper surface 301*a*. For example, there are four suction ports 301*e* angularly spaced at 90° intervals, with only two suction ports 301*e* being illustrated in FIG. 2. Grinding water suction parts 303 are disposed over the respective suction ports 301*e* for drawing in grinding water radially outside of the holder 300. Each of the grinding water suction parts 303 includes a disk of porous member such as ceramics or sponge. The grinding water suction parts 303 are fixed to the upper surface 301*a* in covering relation to the respective suction ports 301*e* by an adhesive or the like. The numbers of the suction channel 301*c*, the suction ports 301*e*, and the grinding water suction parts 303 are not limited to those illustrated in the present embodiment, but they may be provided as a single entity each. The suction ports 301*e* may be replaced with an annular suction port defined in the frame 301 and open at the upper surface 301*a*.

The upper end of the rotational shaft 31, which is of a cylindrical shape and has a vertical axis extending along the Z-axis directions, is fixed to the center of the lower surface of the holding table 30. The rotating means 35 for rotating the rotational shaft 31 about its own axis includes a rotary belt-and-pulley mechanism, for example. The rotary pulley mechanism includes a drive shaft 350 having a vertical axis, a motor 351 fixed to the lower end of the drive shaft 350 for rotating the drive shaft 350 about its own axis, a drive pulley 352 mounted on the upper end of the drive shaft 350, an endless drive belt 353 trained around the drive pulley 352, and a driven pulley 354 mounted on the outer circumferential surface of an upper end portion of the rotational shaft 31. The endless drive belt 353 is also trained around the driven pulley 354. When the motor 351 is energized to rotate the drive shaft 350 about its own axis, the drive shaft 350 rotates the drive pulley 352, which causes the endless drive belt 353 to rotate the driven pulley 354. The rotational shaft 31 is now rotated by the rotational power generated by the rotating driven pulley 354. The rotating means 35 is not limited to the illustrated structural details of the rotary belt-and-pulley mechanism, but may include any of various mechanisms. For example, it may include a motor directly coupled to the lower end of the rotational shaft 31.

The rotational shaft 31 has a first suction channel 311 defined therein that are held in fluid communication with the holder 300 of the holding table 30 and a plurality of second suction channels 312 defined therein that are held in fluid communication with the grinding water suction parts 303. The first suction channel 311, indicated by the broken lines, extends axially in the rotational shaft 31 and has an upper end connected to the suction channel 301*c* in the frame 301. The first suction channel 311 has a lower end portion bent radially outwardly in the rotational shaft 31 and having an outer end that is open at the outer circumferential surface of the rotational shaft 31. The second suction channels 312 extend axially in the rotational shaft 31 and have respective upper ends held in fluid communication with the respective water guide channels 301*d* in the frame 301. The second suction channels 312 have respective lower end portions bent radially outwardly in the rotational shaft 31 and having respective outer ends that are open at the outer circumferential surface of the rotational shaft 31.

The rotational shaft 31 is inserted in a rotary joint 33 of tubular outer profile with bearings 330 interposed therebetween, and is partly surrounded by the rotary joint 33 in a range from the lower end of the rotational shaft 31 to an intermediate region thereof. A small clearance V is defined between the inner circumferential surface of the tubular rotary joint 33 and the outer circumferential surface of the rotational shaft 31. The rotary joint 33 has a communication channel 331 and a communication channel 332 defined therein for passing a fluid through the rotational shaft 31. The communication channel 331 and the communication channel 332 are axially spaced from each other and extend radially inwardly from the outer circumferential surface of the rotary joint 33 toward, but short of, the inner circumferential surface of the rotary joint 33. The communication channel 331 has an outer end that is open at the outer circumferential surface of the rotary joint 33 and connected to a three-way solenoid-operated valve 60 through a pipe 331*a*. Similarly, the communication channel 332 has an outer end that is open at the outer circumferential surface of the rotary joint 33 and connected to the three-way solenoid-operated valve 60 through a pipe 332*a*. To the three-way solenoid-operated valve 60, there are connected the suction source 61 that includes a vacuum generator, a compressor, etc. for generating a suction force and an air supply source 62 that supplies air to the rotary joint 33.

The rotary joint 33 also has an annular groove 333 and an annular groove 334 defined therein which are axially spaced from each other and extend circumferentially fully around the inner circumferential surface of the tubular rotary joint 33. The annular groove 333 is held in fluid communication with the inner end of the communication channel 331, and the annular groove 334 is held in fluid communication with the inner end of the communication channel 332. The annular groove 333 is held in fluid communication via the clearance V with the outer end of the first suction channel 311 that is open at the outer circumferential surface of the rotational shaft 31, and the annular groove 334 is held in fluid communication via the clearance V with the outer end of the second suction channel 312 that is open at the outer circumferential surface of the rotational shaft 31.

As illustrated in FIG. 2, a plurality of mechanical seals 36 (three illustrated in FIG. 2) are disposed in the clearance V between the inner circumferential surface of the tubular rotary joint 33 and the outer circumferential surface of the rotational shaft 31, and axially spaced from each other along the rotational shaft 31. Each of the mechanical seals 36 includes, for example, a rotary sealing ring that is axially movable along the rotational shaft 31 by a spring or the like and rotatable in unison with the rotational shaft 31 and a fixed sealing ring that is axially immovable and nonrotatable. When the suction source 61 illustrated in FIG. 2 is actuated to generate a suction force by drawing in air while the rotational shaft 31 is in rotation, the generated suction force is transmitted through a passageway made up of the first suction channel 311, the annular groove 333, and the clearance V. At this time, the mechanical seals 36 operate to minimize any leakage of the suction force.

Operation of the grinding apparatus 1 when the grinding stones 740 grind the workpiece W held by the holding means 3 while grinding water is being supplied to the workpiece W will be described below with reference to FIGS. 1 and 2.

The workpiece W illustrated in FIG. 1 includes, for example, a semiconductor wafer of circular outer profile that is made of a hard material such as SiC or sapphire, and has a reverse side Wb to be ground by the grinding means 7. The workpiece W has a face side Wa, which is opposite the reverse side Wb, covered with a protective tape T1 applied thereto.

In preparation for grinding the workpiece W, the workpiece W is placed, with the protective tape T1 facing down, on the holding surface 300*a* such that the center of the workpiece W is aligned with the center of the holding table 30 in the loading/unloading region A illustrated in FIG. 1. Then, the suction source 61 illustrated in FIG. 2 is actuated to generate a suction force, which is transmitted through the pipe 331*a*, the communication channel 331, the annular groove 333, the first suction channel 311, and the suction channel 301*c* to the holding surface 300*a*. Now, the holding table 30 holds the workpiece W under suction on the holding surface 300*a*. As illustrated in FIG. 2, the entire holding surface 300*a* of the holding table 30 is covered with the protective tape T1 applied to the workpiece W.

Then, the Y-axis feeding means, not illustrated, disposed beneath the cover 39 is actuated to move the holding table 30 carrying the workpiece W in the +Y direction from the loading/unloading region A to a position below the grinding means 7 in the grinding region B, where the grinding wheel 74 of the grinding means 7 and the workpiece W are positioned with respect to each other. Specifically, as illustrated in FIG. 2, the grinding wheel 74 and the workpiece W are positioned with respect to each other by displacing the central axis of the grinding wheel 74 from the central axis of the holding table 30 by a predetermined distance in a +X direction such that the circular path followed by the outer edges of the grinding stones 740 in the annular array passes through the central axis of the holding table 30.

After the grinding wheel 74 and the workpiece W have thus been positioned with respect to each other, the motor 72 rotates the rotational shaft 70 about its own axis, thereby rotating the grinding wheel 74. The grinding feed means 5 (not illustrated in FIG. 2) is actuated to grinding-feed the grinding means 7 in a −Z direction to bring the grinding stones 740 of the rotating grinding wheel 74 into contact with the reverse side Wb of the workpiece W, grinding the reverse side Wb of the workpiece W. During the grinding process, the rotating means 35 rotates the rotational shaft 31 about its own axis to rotate the holding table 30, so that the workpiece W held on the holding surface 300*a* is also rotated. Therefore, the grinding stones 740 grind the entire reverse side Wb of the workpiece W. The suction force generated by the suction source 61 as it is transmitted from the rotary joint 33 to the rotational shaft 31 is prevented from leaking out by the mechanical seals 36. Therefore, the suction force applied to the holding surface 300*a* and acting on the workpiece W is not reduced during the grinding process. The grinding water supply means 8 supplies grinding water through the channel 70*a* in the rotational shaft 70 to the area where the grinding stones 740 and the workpiece W are held in contact with each other, cooling and cleaning the area where the grinding stones 740 and the reverse side Wb of the workpiece W are held in contact with each other.

The grinding water thus supplied is ejected from the grinding means 7 to cool the area where the grinding stones 740 and the reverse side Wb of the workpiece W are held in contact with each other, removes debris produced from the workpiece W, and flows together with the debris radially outwardly from the reverse side Wb of the workpiece W onto the upper surface 301*a* of the frame 301 that is lower than the upper surface of the holder 300 and lies at the outer circumferential portion of the holding table 30. The suction force generated by the suction source 61 illustrated in FIG. 2 is also transmitted through the pipe 332*a*, the communication channel 332, the annular groove 334, the second suction channel 312, the water guide channel 301*d*, and the suction ports 301*e* to the grinding water suction parts 303. Consequently, part of the grinding water that has flowed down onto the upper surface 301*a* is drawn in by the grinding water suction parts 303.

Since the grinding water suction parts 303 are made of a porous member, the debris contained in the grinding water does not pass through the grinding water suction parts 303, but is blocked and deposited as residue thereon. The grinding water that has been drawn in through the grinding water suction parts 303 flows through the suction ports 301*e*, the water guide channels 301*d*, and the second suction channels 312 into the clearance V between the rotational shaft 31 and the rotary joint 33 and the annular groove 334.

Therefore, even though the holding surface 300*a* of the holding table 30 is covered with the protective tape T1, making it difficult to lead grinding water from the holding surface 300*a* to the rotary joint 33, the grinding apparatus 1 according to the present embodiment allows grinding water to flow into the second suction channels 312, from which the grinding water is introduced into the clearance V between the rotational shaft 31 and the rotary joint 33 during the grinding process. The grinding water thus introduced into and present in the clearance V is effective to lower the frictional heat generated by the rotating rotational shaft 31 and the mechanical seals 36 to prevent the rotary joint 33 from malfunctioning and to increase the sealing capability of the mechanical seals 36. Since the water that is led into the rotary joint 33 is grinding water, the grinding apparatus 1 is not required to have a separate water source for supplying water dedicated to prevent the rotary joint 33 from being damaged. Therefore, the grinding apparatus 1 is economical.

When the workpiece W has been ground to a predetermined thickness and hence the grinding of the workpiece W is completed, the grinding feed means 5 illustrated in FIG. 1 lifts the grinding means 7 in a +Z direction away from the ground workpiece W.

The Y-axis feeding means, not illustrated, disposed beneath the cover 39 is actuated to move the holding table 30 carrying the workpiece W in a −Y direction back into its original position in the loading/unloading region A. The rotating means 35 is inactivated to stop rotating the holding table 30, and the ground workpiece W is unloaded from the holding table 30. Specifically, the suction source 61 is inactivated to stop generating the suction force, releasing the workpiece W from the holding table 30. Furthermore, the three-way solenoid-operated valve 60 illustrated in FIG. 2 is actuated to bring the pipes 331*a* and 332*a* into fluid communication with the air supply source 62. The air supply source 62 then supplies air through three-way solenoid-operated valve 60 to the pipes 331*a* and 332*a*. The air supplied to the pipe 331*a* flows through the communication channel 331, the annular groove 333, the first suction channel 311, and the suction channel 301*c*, from which the air is ejected upwardly through the holder 300 and the holding surface 300*a*. The pressure of the ejected air lifts the workpiece W off the holding surface 300*a*, eliminating the vacuum suction remaining between the holding surface 300*a* and the workpiece W, so that the workpiece W can reliably be removed from the holding table 30.

The air supplied to the pipe 332*a* flows through the communication channel 332, the annular groove 334, the second suction channel 312, and the water guide channels 301*d*, from which the air is ejected through the grinding water suction parts 303. The pressure of the ejected air removes the deposited residue from the grinding water suction parts 303, cleaning the grinding water suction parts 303. Therefore, when a next workpiece W is ground by the grinding means 7, it is possible to draw in grinding water through the grinding water suction parts 303.

After the ground workpiece W has been unloaded from the holding table 30, a next workpiece W to be ground is placed and held on the holding table 30, and is ground in the same manner as described above.

The grinding apparatus 1 according to the present invention is not limited to the first embodiment described above. The sizes, shapes, and structural details of the grinding apparatus 1 illustrated in FIGS. 1 and 2 are not limited to those illustrated, but may be modified within the scope of the present invention insofar as the advantages of the invention remain effective and useful.

Figure 3:
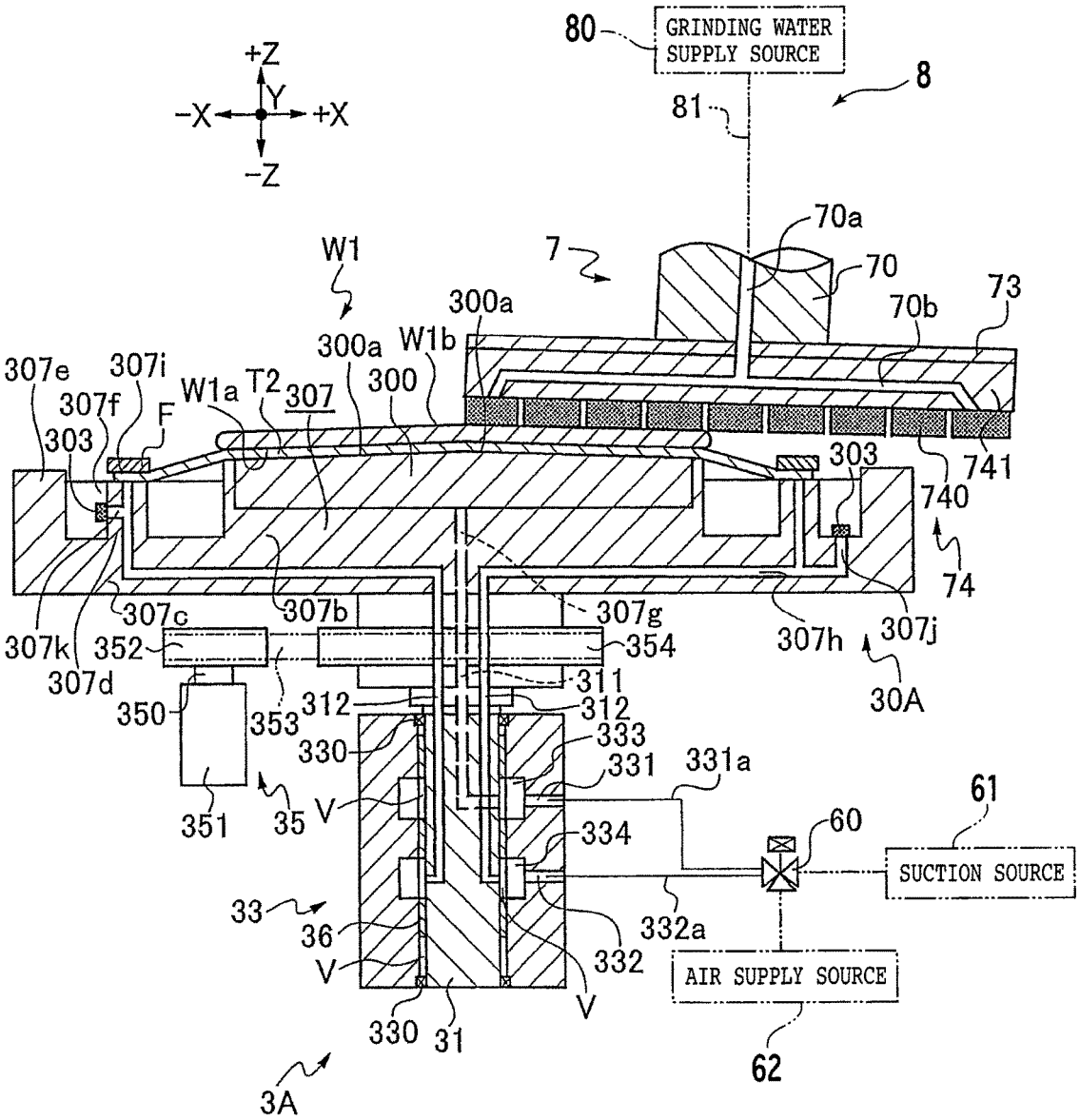
FIG. 3 is a vertical cross-sectional view of structural details of grinding means and holding means of a grinding apparatus according to a modification of the present invention, the holding means including a holding table for holding a workpiece supported on an annular frame under suction thereon.

For example, the grinding apparatus 1 according to the present invention may have holding means 3A illustrated in FIG. 3. The holding means 3A is a modification of part of the holding means 3 illustrated in FIG. 2. Specifically, the holding means 3A has a holding table 30A rather than the holding table 30 of the holding means 3 illustrated in FIG. 2. Other details of the holding means 3A are similar to those of the holding means 3. The holding table 30A is able to hold a workpiece W1 under suction that is supported on an annular frame F.

The workpiece W1 illustrated in FIG. 3 includes, for example, a semiconductor wafer of circular outer profile. A protective tape T2 that is larger in diameter than the workpiece W1 is applied to a face side W1*a* of the workpiece W1. The protective tape T2 has an outer circumferential portion applied to the annular frame F, so that the workpiece W1 is supported on the annular frame F by the protective tape T2. The workpiece W1 has an upwardly facing reverse side W1*b*, which is opposite the face side W1*a*, to be ground by the grinding apparatus.

The holding table 30A includes a holder 300 having a circular outer profile and made of a porous member or the like, for holding the workpiece W1 under suction thereon, and a frame 307 supporting the holder 300 thereon. The holder 300 has an upper exposed holding surface 300*a* formed as a conical surface, for example, whose vertex is aligned with the center of the holding table 30A. The holder 300 is held in fluid communication with the suction source 61 illustrated in FIG. 3.

The frame 307 has a flat plate 307*c* extending radially outwardly, i.e., in a direction that is horizontally perpendicular to the axis of the rotational shaft 31, from a base portion 307*b* of the frame 307. The frame 307 also includes an annular holder 307*d* projecting in the +Z direction from the flat plate 307*c* at a position spaced radially outwardly from, but closely to, the base portion 307*b* of the frame 307, and an annular outer wall 307*e* projecting in the +Z direction from the flat plate 307*c* at a position spaced radially outwardly from the annular holder 307*d*. The annular holder 307*d* and the annular outer wall 307*e* jointly define therebetween an annular recess 307*f* having a drain port, not illustrated.

The base portion 307*b* of the frame 307 has a suction channel 307*g*, indicated by the broken lines, defined centrally therein and extending thicknesswise in the Z-axis directions. The suction channel 307*g* has an upper end held in fluid communication with the holder 300 and a lower end held in fluid communication with the first suction channel 311 in the rotational shaft 31.

The frame 307 has a plurality of water guide channels 307*h* defined therein for passing grinding water therethrough, which extend radially outwardly from the base portion 307*b* to the annular holder 307*d*. The annular holder 307*d* has an upper surface serving as an annular holding surface 307*i* for holding the annular frame F supporting the workpiece W1 under suction thereon. The water guide channels 307*h* have respective upper ends that are open on the annular holding surface 307*i*. The open upper ends of the water guide channels 307*h* are positioned at circumferentially spaced regular intervals on the annular holding surface 307*i*. For example, there are four open upper ends of the water guide channels 307*h* angularly spaced at 90° intervals, with only two open upper ends being illustrated in FIG. 3. The water guide channels 307*h* have respective lower ends held in fluid communication with the second suction channels 312 in the rotational shaft 31. The annular holding surface 307*i* of the annular holder 307*d* may have an annular groove defined therein, and the upper ends of the water guide channels 307*h* may be held in fluid communication with the annular groove.

Grinding water suction parts 303 are disposed on the bottom surface and inner side surface of the annular recess 307*f* for drawing in grinding water radially outside of the holder 300. The grinding water suction parts 303 are fixed to the bottom surface and inner side surface of the annular recess 307*f* by an adhesive or the like in covering relation to suction ports 307*j* defined in the bottom surface of the annular recess 307*f* and held in fluid communication with the water guide channels 307*h* and suction ports 307*k* defined in the inner side surface of the annular recess 307*f* and held in fluid communication with the water guide channels 307*h*. The frame 307 may have at least either the suction ports 307*j* or the suction ports 307*k*, and may have a single suction port 307*j* or a plurality of suction ports 307*j* or a single suction port 307*k* or a plurality of suction ports 307*k*. The number of the grinding water suction parts 303 may be varied depending on the number of the suction ports 307*j* or the suction ports 307*k*.

Operation of the grinding apparatus 1 when the grinding stones 740 grind the workpiece W1 held by the holding means 3A while grinding water is being supplied to the workpiece W1 will be described below with reference to FIGS. 1 and 3.

In preparation for grinding the workpiece W1, the workpiece W1 is placed, with the protective tape T2 facing down, on the holding surface 300*a*, and the annular frame F supporting the workpiece W1 is held on the annular holding surface 307*i* with the protective tape T2 interposed therebetween. Then, the suction source 61 illustrated in FIG. 3 is actuated to generate a suction force, which is transmitted through the pipe 331*a*, the communication channel 331, the annular groove 333, the first suction channel 311, and the suction channel 307*g* to the holding surface 300*a*. Now, the holding table 30 holds the workpiece W1 under suction on the holding surface 300*a*. The suction force generated by the suction source 61 is also transmitted through the pipe 332*a*, the communication channel 332, the annular groove 334, the second suction channel 312, and the water guide channels 307*h* to the annular holding surface 307*i*. The annular frame F is thus held under suction on the annular holding surface 307*i*. As illustrated in FIG. 3, the entire holding surface 300*a* of the holding table 30A is covered with the protective tape T2 applied to the workpiece W1.

Then, the holding table 30A carrying the workpiece W is moved in the +Y direction to a position below the grinding means 7, where the grinding wheel 74 of the grinding means 7 and the workpiece W1 are positioned with respect to each other. The rotating grinding wheel 74 is lowered in the −Z direction into contact with the reverse side W1*b* of the workpiece W1, grinding the reverse side W1*b* of the workpiece W1. During the grinding process, the rotating means 35 rotates the rotational shaft 31 about its own axis to rotate the holding table 30A, so that the workpiece W1 held on the holding surface 300*a* is also rotated. Therefore, the grinding stones 740 grind the entire reverse side W1*b* of the workpiece W1. The grinding water supply means 8 supplies grinding water to the area where the grinding stones 740 and the workpiece W1 are held in contact with each other, cooling and cleaning the area where the grinding stones 740 and the reverse side W1*b* of the workpiece W1 are held in contact with each other.

The grinding water thus supplied is ejected from the grinding means 7 and flows together with debris produced from the workpiece W1 radially outwardly from the reverse side W1*b* of the workpiece W1 into the annular recess 307*f*. The suction force generated by the suction source 61 illustrated in FIG. 3 is branched from the water guide channels 307*h* into the suction port 307*j* or 307*k* and acts on the grinding water suction parts 303. Consequently, part of the grinding water that has flowed into the annular recess 307*f* is drawn in by the grinding water suction parts 303. The grinding water that is not drawn in by the grinding water suction parts 303 is discharged out through the drain port, not illustrated.

The debris contained in the grinding water is blocked and deposited as residue on the grinding water suction parts 303. The grinding water that has been drawn in through the grinding water suction parts 303 flows through the suction port 307*j* or 307*k*, the water guide channels 307*h*, and the second suction channels 312 into the clearance V between the rotational shaft 31 and the rotary joint 33 and the annular groove 334.

Therefore, even though the holding surface 300*a* of the holding table 30A is covered with the protective tape T2, making it difficult to lead grinding water from the holding surface 300*a* to the rotary joint 33, the grinding apparatus 1 according to the present modification allows grinding water to flow into the second suction channels 312, from which the grinding water is introduced into the clearance V between the rotational shaft 31 and the rotary joint 33 during the grinding process. The grinding water thus introduced into the clearance V is effective to lower the frictional heat generated by the rotating rotational shaft 31 and the mechanical seals 36 to prevent the rotary joint 33 from malfunctioning and to increase the sealing capability of the mechanical seals 36. Since the water that is led into the rotary joint 33 is grinding water, the grinding apparatus 1 is not required to have a separate water source for supplying water dedicated to prevent the rotary joint 33 from being damaged due to the frictional heat. Therefore, the grinding apparatus 1 is economical.

The present invention is not limited to the details of the above described preferred embodiment. The scope of the invention is defined by the appended claim and all changes and modifications as fall within the equivalence of the scope of the claim are therefore to be embraced by the invention.

What is claimed is:

1. A grinding apparatus comprising:

holding means for holding a workpiece; and grinding means for grinding the workpiece held by said holding means with a grinding stone while supplying grinding water to the workpiece, wherein said holding means includes a holding table having a holder for holding the workpiece under suction and a grinding water suction part spaced from said holder and configured for drawing in grinding water outside of said holder, a rotational shaft having an end fixed centrally to a bottom surface of said holding table, a tubular rotary joint surrounding said rotational shaft, and rotating means for rotating said rotational shaft about its own axis, said rotational shaft has a first suction channel held in fluid communication with said holder of said holding table and a second suction channel held in fluid communication with said grinding water suction part, said tubular rotary joint has a communication channel by which said first suction channel and said second suction channel are held in fluid communication with at least a suction source, and grinding water flowing into said second suction channel is present between said rotational shaft and said rotary joint.

2. The grinding apparatus of claim 1, further comprising a clearance defined between an inner circumferential surface of said tubular rotary joint and an outer circumferential surface of said rotational shaft.

3. The grinding apparatus of claim 2, further comprising at least one seal disposed in said clearance.

4. The grinding apparatus of claim 1, wherein said holding table includes two grinding water suction parts, said two grinding water suction parts being located on opposing sides of said holding means.

5. The grinding apparatus of claim 4, wherein said two grinding water suction parts are spaced from said holding means.

6. The grinding apparatus of claim 1, wherein an upper surface of said holding means is a conical surface.

7. The grinding apparatus of claim 1, wherein said grinding means includes a plurality of channels configured for ejecting water.

* * * * *